US011738831B2

(12) United States Patent
Niemier

(10) Patent No.: US 11,738,831 B2
(45) Date of Patent: Aug. 29, 2023

(54) RECONFIGURABLE WATERCRAFT

(71) Applicant: Timothy A. Niemier, Bellingham, WA (US)

(72) Inventor: Timothy A. Niemier, Bellingham, WA (US)

(73) Assignee: ORIGAMI PADDLER, LLC, Bellingham, WA (US)

( * ) Notice: Subject to any disclaimer, the term of this patent is extended or adjusted under 35 U.S.C. 154(b) by 27 days.

(21) Appl. No.: 17/320,717

(22) Filed: May 14, 2021

(65) Prior Publication Data

US 2021/0354792 A1 Nov. 18, 2021

Related U.S. Application Data

(60) Provisional application No. 63/155,299, filed on Mar. 1, 2021, provisional application No. 63/024,968, filed on May 14, 2020.

(51) Int. Cl.
*B63B 34/23* (2020.01)
*B63B 3/46* (2006.01)

(52) U.S. Cl.
CPC ..... *B63B 34/23* (2020.02); *B63B 3/46* (2013.01)

(58) Field of Classification Search
CPC ..... B63B 34/23; B63B 3/46
USPC ..... 114/352, 353, 354
See application file for complete search history.

(56) References Cited

U.S. PATENT DOCUMENTS 4,366,769 A * 1/1983 Lingeman ..... B65D 85/00 114/352
6,615,762 B1 * 9/2003 Scott ..... B63B 7/06 114/353
7,347,755 B1 * 3/2008 Katzfey ..... B63B 32/53 441/74
9,422,029 B1 * 8/2016 Niemier ..... B63B 34/23
2008/0246236 A1 * 10/2008 Lombano ..... A63C 5/02 280/18

FOREIGN PATENT DOCUMENTS

RU 20071331171 A 2/2009

OTHER PUBLICATIONS

International Searching Authority, International Search Report and the Written Opinion, dated Aug. 12, 2021, 10 pages.

* cited by examiner

*Primary Examiner* — Daniel V Venne
(74) *Attorney, Agent, or Firm* — Schacht Law Office, Inc.; Michael R. Schacht

(57) ABSTRACT

A reconfigurable watercraft comprising a bow section, at least one intermediate section, a stern section, and first and second connecting systems. The first and second connecting systems are configured to allow the watercraft be configured in first and second configurations. In the first configuration, a position of the bow section to the at least one intermediate section is fixed and a position of the stern section relative to the at least one intermediate section. In the second configuration, the bow section is allowed to be displaced relative the at least one intermediate section and the stern section is allowed to be displaced relative to the at least one intermediate section.

8 Claims, 16 Drawing Sheets

RECONFIGURABLE WATERCRAFT

RELATED APPLICATIONS

This application, U.S. patent application Ser. No. 17/320,717 filed May 14, 2021, claims benefit of U.S. Provisional Application Ser. No. 63/155,299 filed Mar. 1, 2021.

This application also claims benefit of U.S. Provisional Application Ser. No. 63/024,968 filed May 14, 2020.

The contents of all related applications are incorporated herein by reference.

TECHNICAL FIELD

This application relates to small watercraft such as kayaks, canoes, row boats, sail boats, and paddle boards and, more particularly, to small watercraft that can be folded for ease of storage and/or transportation.

BACKGROUND

The present invention relates to small watercraft such as kayaks, canoes, row boats, sail boats, and paddle boards that may be folded to obtain a smaller form factor to facilitate storage and/or transportation of the kayak. The present invention is of particular significance when applied to kayaks and paddle boards, and examples of the application of the principles of the present invention will be described herein in the context of a watercraft that can function as a kayak and as a paddle board. The principles of the present invention are, however, more generally applicable to other types of small watercraft such as canoes, row boats, and sail boats. The scope of the present invention should thus be determined with respect to the claims appended hereto and not the following description of several examples of the invention.

Conventional reconfigurable watercraft have not seen a large degree of commercial success because such watercraft have typically lacked the stability, reliability, ease of use and other desirable characteristics of a traditional, one-piece watercraft. Previous reconfigurable watercraft thus exhibit problems that prevented widespread adoption of reconfigurable watercraft.

One purpose of the present invention is to provide a reconfigurable watercraft that provides enhanced stability, reliability, and ease of use.

SUMMARY

The present invention may be embodied as a reconfigurable watercraft comprising a bow section, at least one intermediate section, a stern section, a first connecting system, and a second connecting system. The first connecting system comprises at least one connecting assembly comprising at least one connecting portion secured to of the bow section, at least one connecting portion secured to the intermediate section, and at least one connecting member. The second connecting system comprises at least one connecting assembly comprising at least one connecting portion secured to the stern section, at least one connecting portion secured to the intermediate section, and at least one connecting member. The reconfigurable watercraft is configurable in a first configuration and in a second configuration. In the first configuration, the at least one connecting member of the first connecting system engages the at least one connecting portion of the first connecting system secured to the bow section and the at least one connecting portion of the first connecting system secured to the intermediate section to inhibit movement of the bow section relative to the at least one intermediate section. In the first configuration, the at least one connecting member of the second connecting system engages the at least one connecting portion of the second connecting system secured to the intermediate section and the at least one connecting portion of the second connecting system secured to the stern section to inhibit movement of the stern section relative to the at least one intermediate section. In the second configuration, The at least one connecting member of the first connecting system engages the at least one connecting portion of the first connecting system secured to the bow section and the at least one connecting portion of the first connecting system secured to the intermediate section to allow pivoting movement of the bow section relative to the at least one intermediate section. In the second configuration, the at least one connecting member of the second connecting system engages the at least one connecting portion of the second connecting system secured to the intermediate section and the at least one connecting portion of the second connecting system secured to the stern section to allow pivoting movement of the stern section relative to the at least one intermediate section.

The present invention may be embodied as a method of reconfiguring a watercraft between first and second configurations comprising the following steps. Aa bow section, at least one intermediate section, a stern section, a first and second connecting systems are provided. The first connecting system comprises at least one connecting assembly comprising at least one connecting portion secured to of the bow section, at least one connecting portion secured to the intermediate section, and at least one connecting member. The second connecting system comprises at least one connecting assembly comprising at least one connecting portion secured to the stern section, at least one connecting portion secured to the intermediate section, and at least one connecting member. The watercraft is arranged in the first configuration by engaging the at least one connecting member of the first connecting system with the at least one connecting portion of the first connecting system secured to the bow section and the at least one connecting portion of the first connecting system secured to the intermediate section to inhibit movement of the bow section relative to the at least one intermediate section and engaging the at least one connecting member of the second connecting system with the at least one connecting portion of the second connecting system secured to the intermediate section and the at least one connecting portion of the second connecting system secured to the stern section to inhibit movement of the stern section relative to the at least one intermediate section. The watercraft is arranged in the second configuration by engaging the at least one connecting member of the first connecting system with the at least one connecting portion of the first connecting system secured to the bow section and the at least one connecting portion of the first connecting system secured to the intermediate section to allow pivoting movement of the bow section relative to the at least one intermediate section and engaging the at least one connecting member of the second connecting system with the at least one connecting portion of the second connecting system secured to the intermediate section and the at least one connecting portion of the second connecting system secured to the stern section to allow pivoting movement of the stern section relative to the at least one intermediate section.

DETAILED DESCRIPTION

Figure 1:
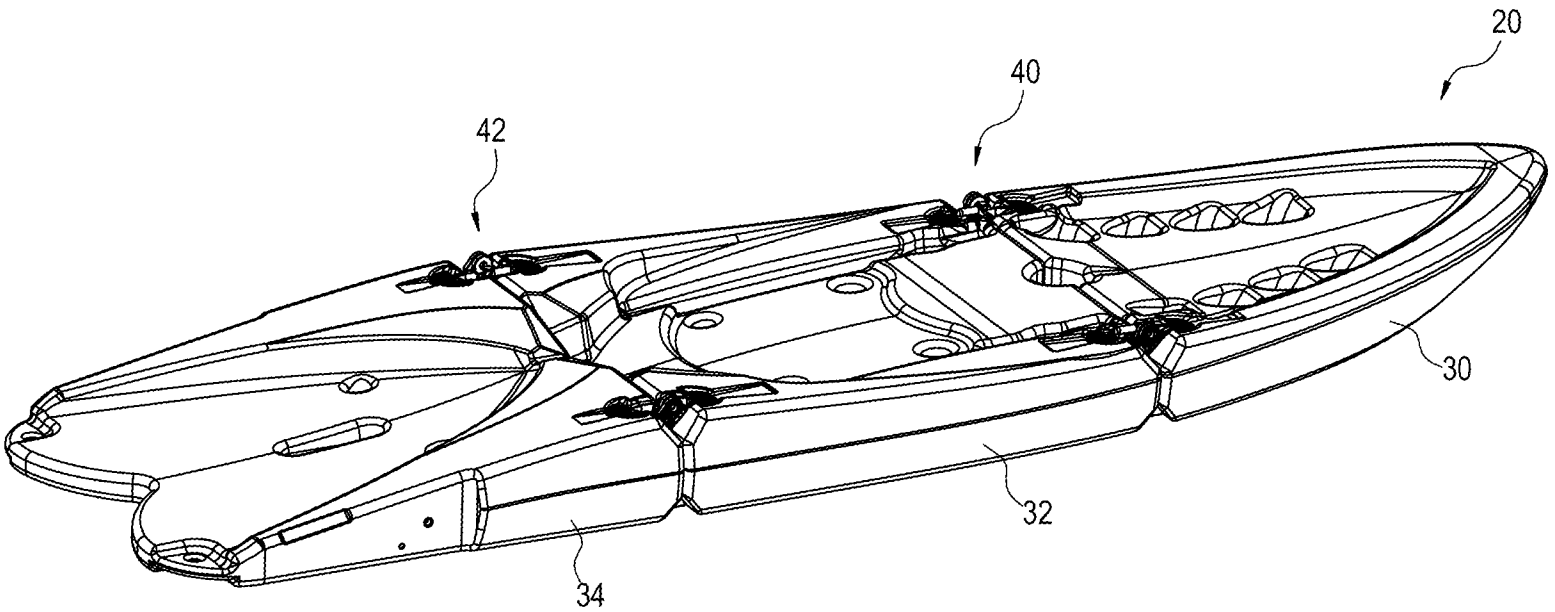
FIG. 1 is a perspective view of a first example reconfigurable watercraft of the present invention in a first configuration.
Figure 2:
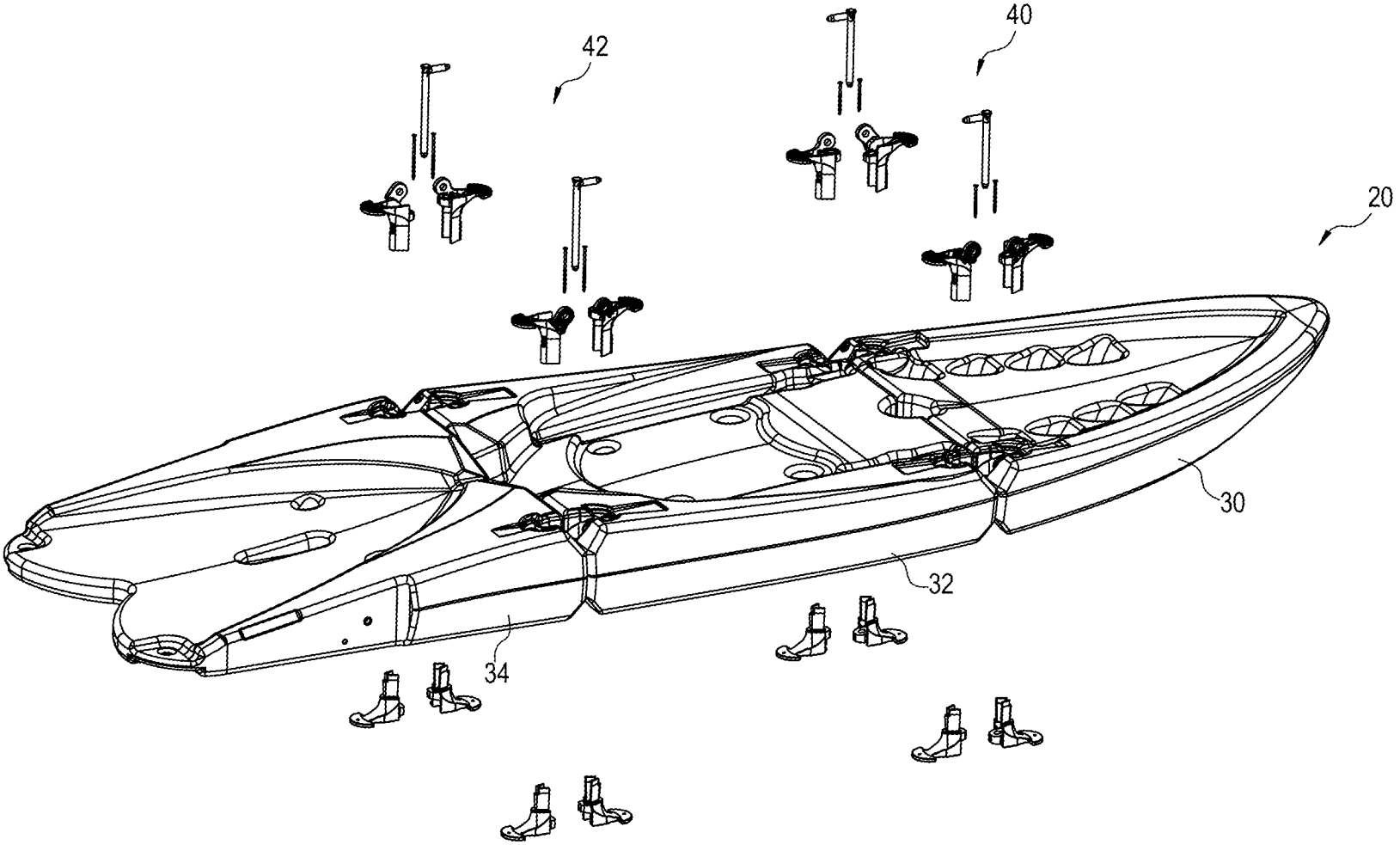
FIG. 2 is a perspective, exploded view of the first example reconfigurable watercraft in the first configuration.

Referring initially to FIGS. 1 and 2 of the drawing, depicted therein is a first example watercraft 20 comprising bow, intermediate, and stern sections 30, 32, and 34 and first and second connecting systems 40 and 42. As perhaps best shown in FIG. 3, when in the first configuration the first example watercraft 20 defines a watercraft longitudinal axis AL. A watercraft reference plane PW extends through the watercraft longitudinal axis AL and is perpendicular to the page in FIG. 3.

FIGS. 3 through 7 illustrate that the first example water craft may be reconfigured between a first configuration (FIGS. 1 and 3) in which the first and second connecting systems 40 and 42 secure the bow, intermediate, and stern sections 30, 32, and 34 together to allow the watercraft to be used and a second configuration (FIGS. 4-7). The example watercraft 20 is typically arranged in the second configuration for storage and transportation.

As shown in FIGS. 8-11, each of the connecting systems 40 and 42 comprises at least one connecting assembly 50 comprising a first connecting portion 52, a second connecting portion 54, a first example connecting member 56, and a bungee member 58. The example watercraft 20 comprises four of the example connecting assemblies 50, and all four of the example connecting assemblies are or may be the same, so only one of the four example connecting assemblies 50 will be described herein in detail.

Figure 8:
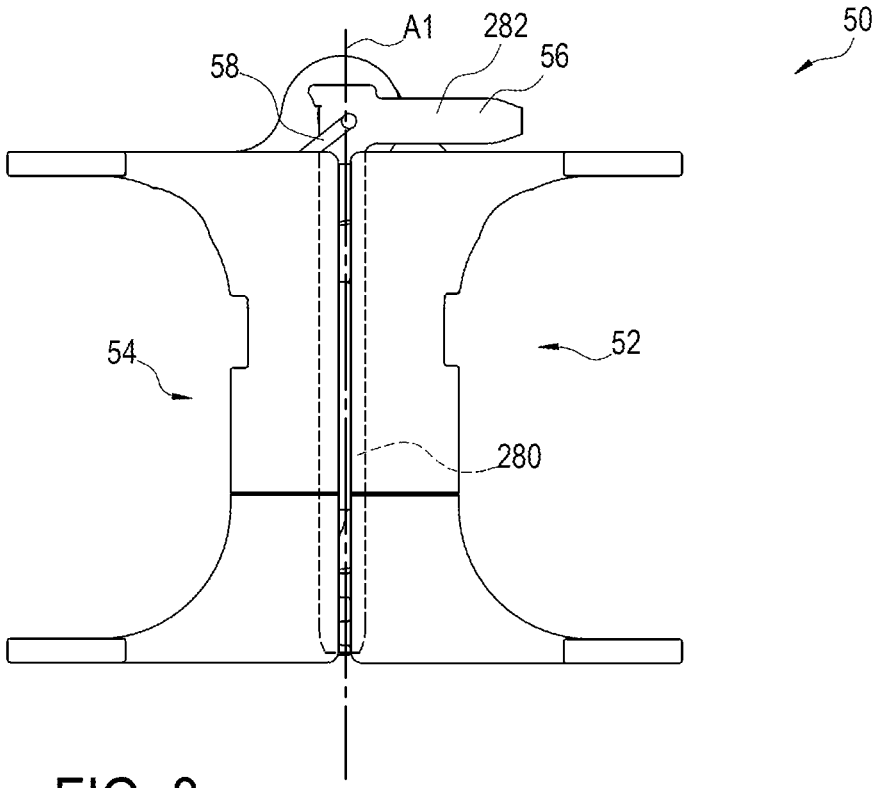
FIG. 8 is a side elevation view of a first example connecting assembly of the first example foldable kayak in a locked configuration.
Figure 9:
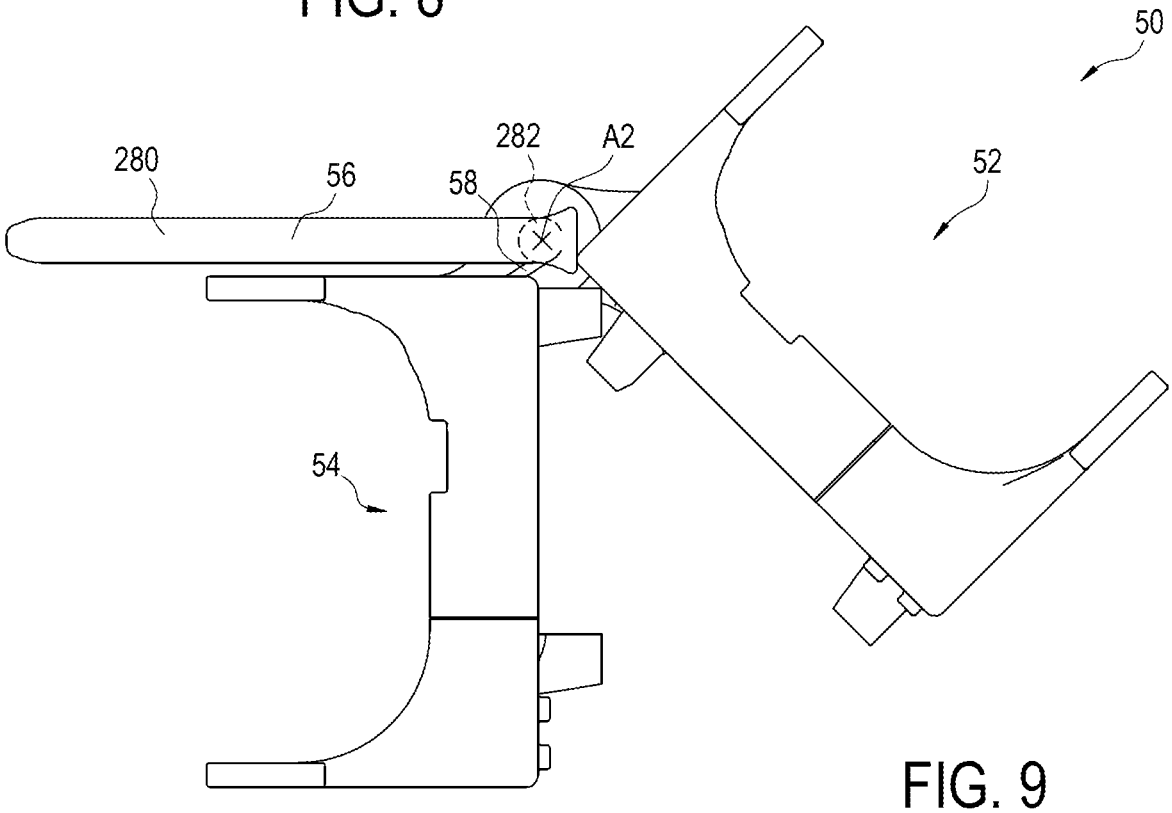
FIG. 9 is a side elevation view of the first example connecting assembly in a pivoting configuration.
Figure 11:
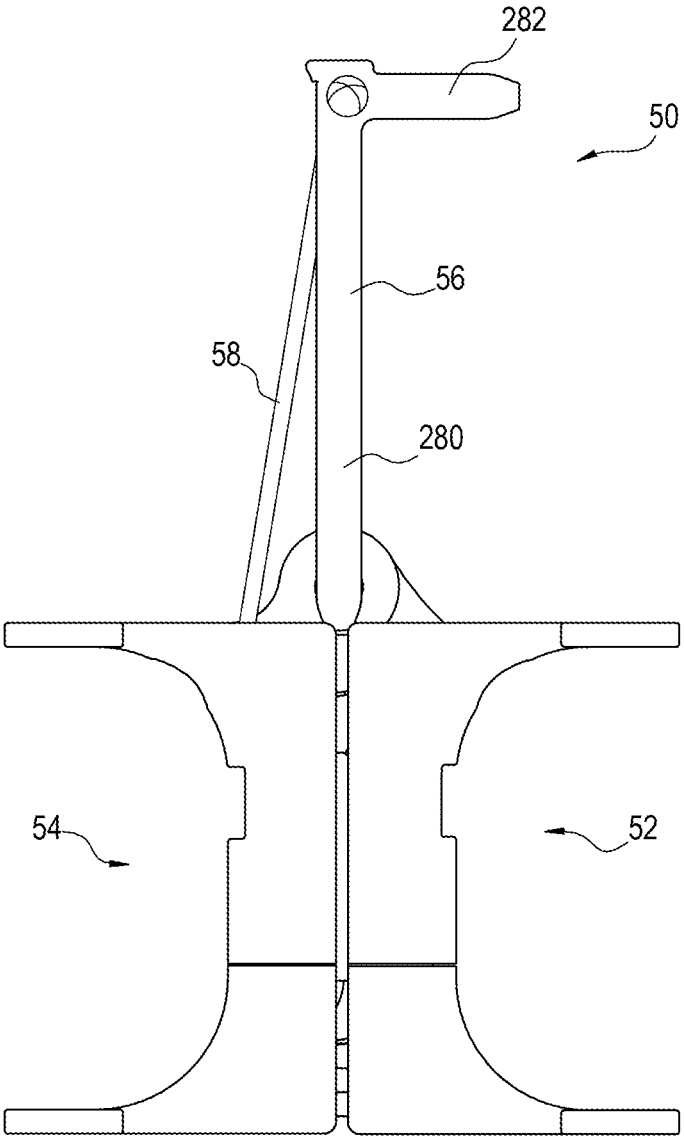
FIG. 11 is side elevation view illustrating interaction of a bungee cord with a connecting member of the first example connecting assembly when the first example connecting assembly is reconfigured between the locked and pivoting configurations.

FIG. 8 illustrates the example connecting assembly 50 in a locked configuration. FIG. 9 illustrates the example connecting assembly 50 in a pivoting configuration. FIG. 11 illustrates the process of reconfiguring the example connecting assembly 50 between the locked and pivoting configurations.

More specifically, FIG. 8 illustrates that the first example connecting member 56 extends along a first axis A1 to prevent movement of the first and second connecting portions 52 and 54 in the locked position. The first axis A1 extends at an angle relative to the reference plane P when the first example connecting member 56 is in the locked position and the watercraft 20 is in the first configuration. With the first example connecting member 56 in the locked position as depicted in FIG. 8, the first example connecting member 56 is substantially perpendicular to the reference plane P.

FIG. 9 illustrates that the first example connecting member 56 extends along a second axis A2 when engaging the first and second connecting portions 52 and 54 in the locked position. The second axis A2 is substantially parallel to the reference plane P and lateral to a longitudinal axis of the example watercraft 20 during use.

As shown in FIG. 11, the example bungee member 58 limits movement of the connecting member relative to one or both of the connecting portions 52 and 54. FIG. 11 also illustrates that the bungee member 58 must be elongated or stretched as the first example connecting member 56 is reconfigured between the locked and pivoting configurations. In addition, the bungee member 58 is arranged relative to the first example connecting member 56 and the connecting portions 52 and/or 62 such that elongation of the bungee member 58 applies a biasing force to the first example connecting member 56 that inhibits or substantially prevents movement of the first example connecting member 56 relative to at least one of the connecting portions 52 and 54 when the connecting systems 40 and 42 in either of the locked and pivot configurations.

Figure 10:
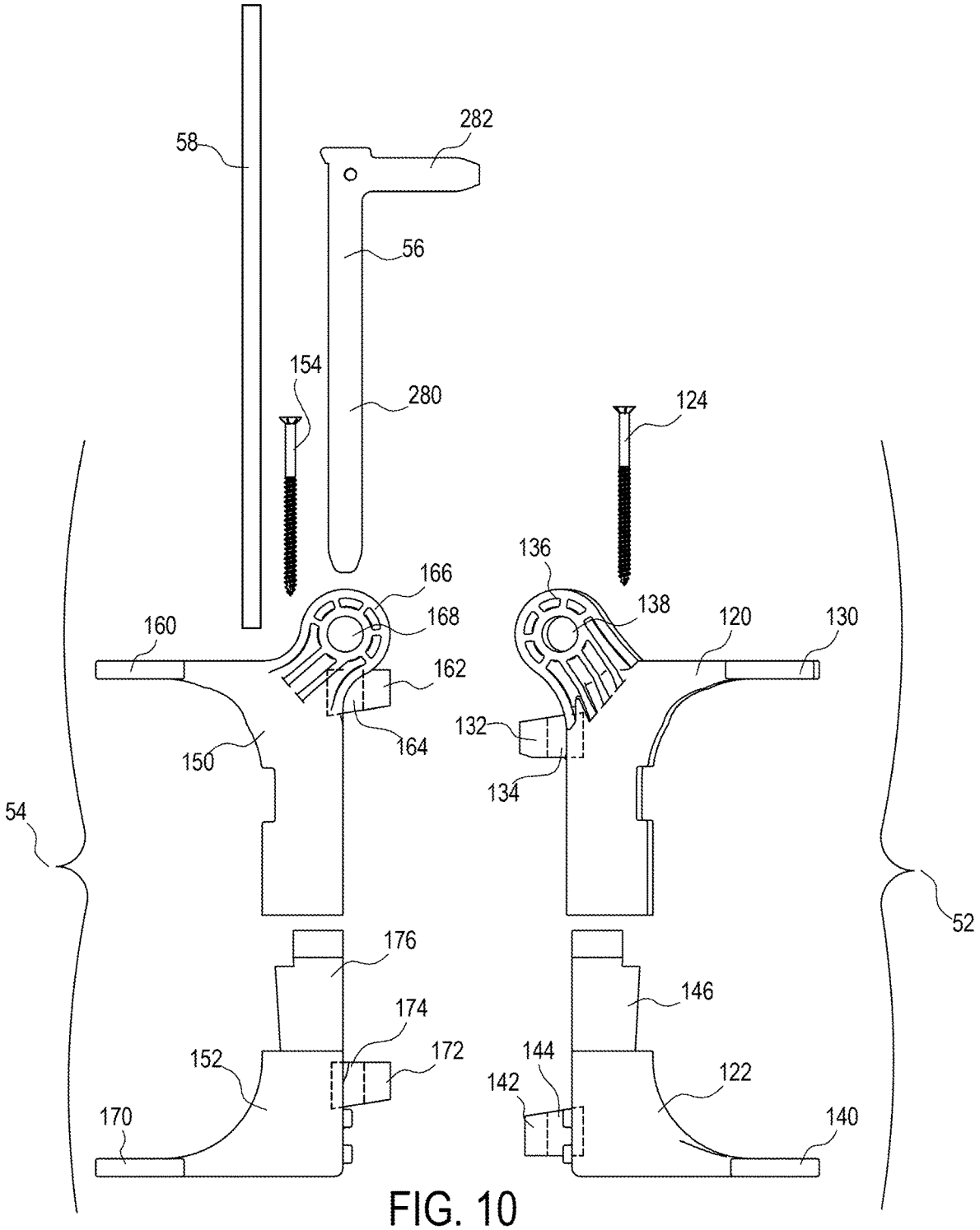
FIG. 10 is a side elevation, exploded view of the first example connecting assembly of the first example foldable kayak.

FIG. 10 illustrates that the example first connecting portion 52 comprises a first upper member 120, a first lower member 122, and a first fastener 124. The first upper member 120 defines a first upper key tab 130, a first upper lock projection 132 defining a first upper lock opening 134, and a first hinge projection 136 defining a first pivot opening 138. The first lower member 122 defines a first lower key tab 140, a first lower lock projection 142 defining a first lower lock opening 144, and a first engaging projection 146. FIG. 10 further that the example second connecting portion 54 comprises a second upper member 150, a second lower member 152, and a second fastener 154. The second upper member 150 defines a second upper key tab 160, a second upper lock projection 162 defining a second upper lock opening 164, and a second hinge projection 166 defining a second pivot opening 168. The second lower member 122 defines a second lower key tab 170, a second lower lock projection 172 defining a second lower lock opening 174, and a second engaging projection 176.

The fastener 124 secures the first upper member 120 and first lower member 122 to form the first connecting portion 52. When the first upper member 120 and first lower member are secured together by the fastener 124, the lock openings 134 and 144 are aligned. Further, the key tabs 130 and 140 are received within corresponding key sockets (not shown in FIGS. 8 and 9) in one of the watercraft sections 30, 32, or 34 to clamp or otherwise secure the first connecting portion 52 to the appropriate one of the sections 30, 32, and 34.

Similarly, the fastener 154 secures the second upper member 150 and second lower member 152 to form the second connecting portion 54 such that the lock openings 164 and 174 are aligned. Further, the key tabs 160 and 170 are received within corresponding key sockets (not shown in FIGS. 8 and 9) in one of the watercraft sections 30, 32, or 34 to clamp or otherwise secure the second connecting portion 54 to the appropriate one of the sections 30, 32, and 34.

FIG. 8 illustrates that the lock openings 134, 144, 164 and 174 are aligned and centered relative to the first axis A1 when the connecting assembly 50 is in the locked configuration. FIGS. 8 and 9 illustrate that the first and second pivot openings 138 and 168 are aligned and centered relative to the second axis A2 during use of the connecting assembly 50.

Turning now to FIGS. 10-17, the first example connecting assembly 50 and the connection of the first example connecting assembly 50 to any pair of the watercraft sections 30 and 32 or 32 and 34 to form a part of either of the first and second connecting systems 40 or 42 will be described in further detail. The example watercraft sections 30, 32, and 34 are typically hollow plastic members, typically made using a blow-molding process, but any construction of suitable buoyancy, weight, rigidity, and wearability, such as roto-molded, vacuum-formed, and/or thermo-formed plastic, foam, composite (e.g., carbon fiber, fiberglass), or the like, or combinations thereof, can be used to form the watercraft sections 30, 32, and 34. The example watercraft sections 30, 32, and 34 thus are or may be conventional and will not be described in detail herein.

Figure 3:
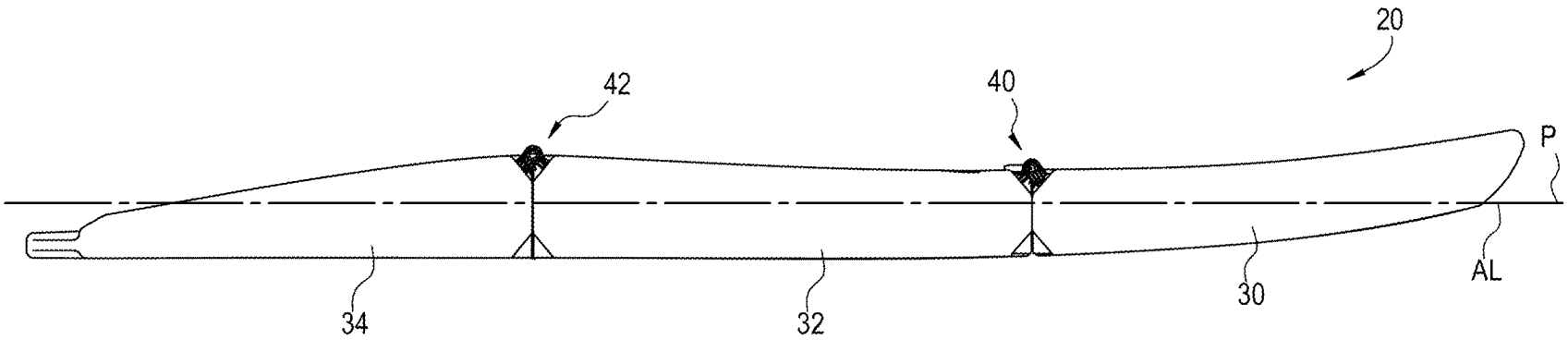
FIG. 3 is a side elevation view of the first example foldable kayak in the first configuration.
Figure 4:
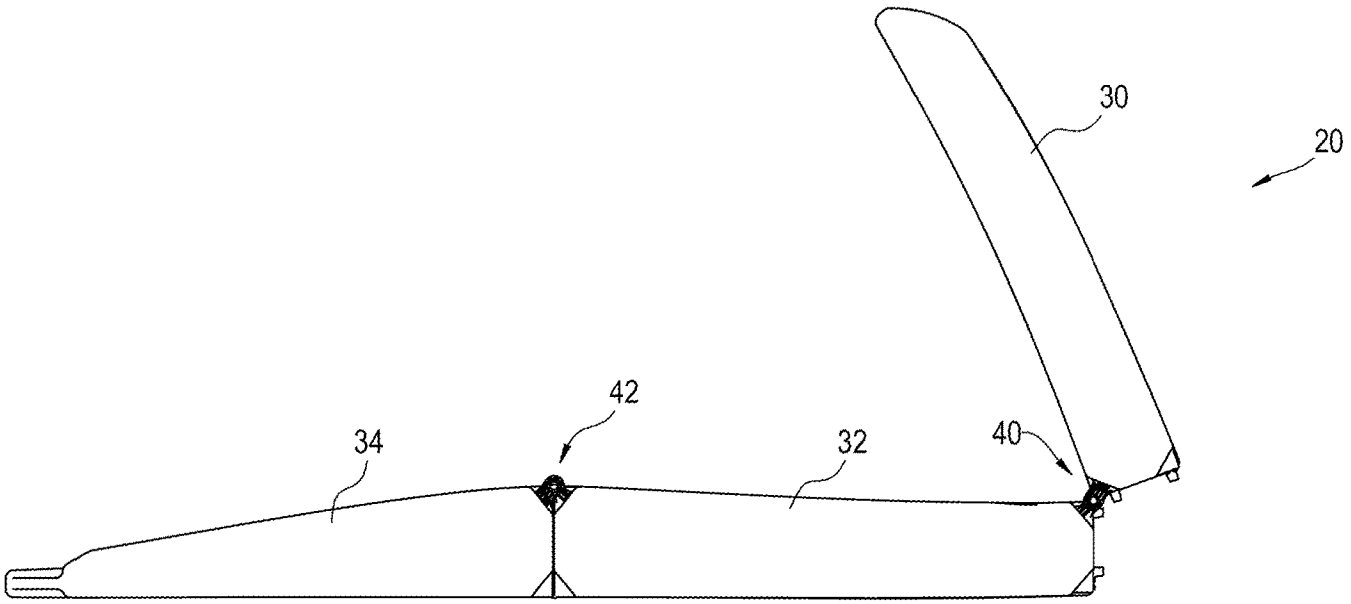
FIG. 4 is a side elevation view illustrating a first step of a process of converting the first example foldable kayak from the first configuration to a second configuration.
Figure 12:
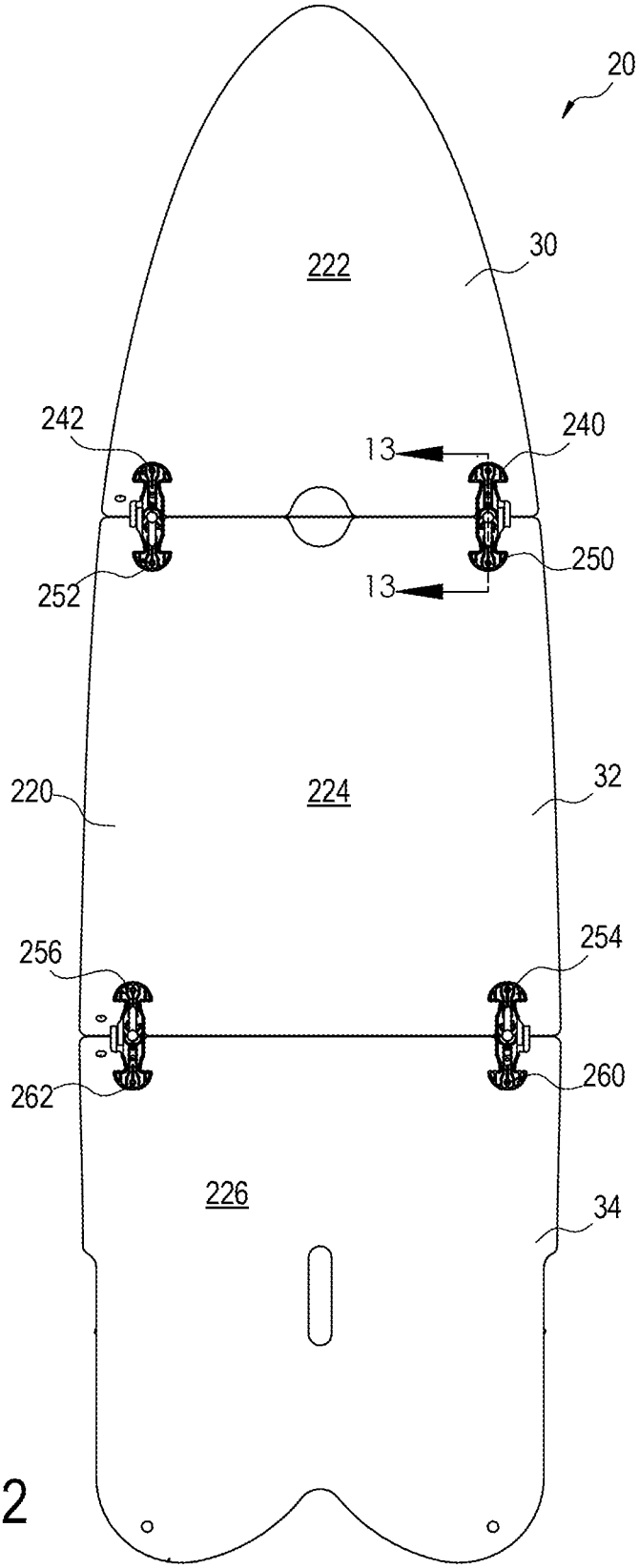
FIG. 12 is a top plan view of the first example reconfigurable watercraft of the present invention in the first configuration.
Figure 13A:
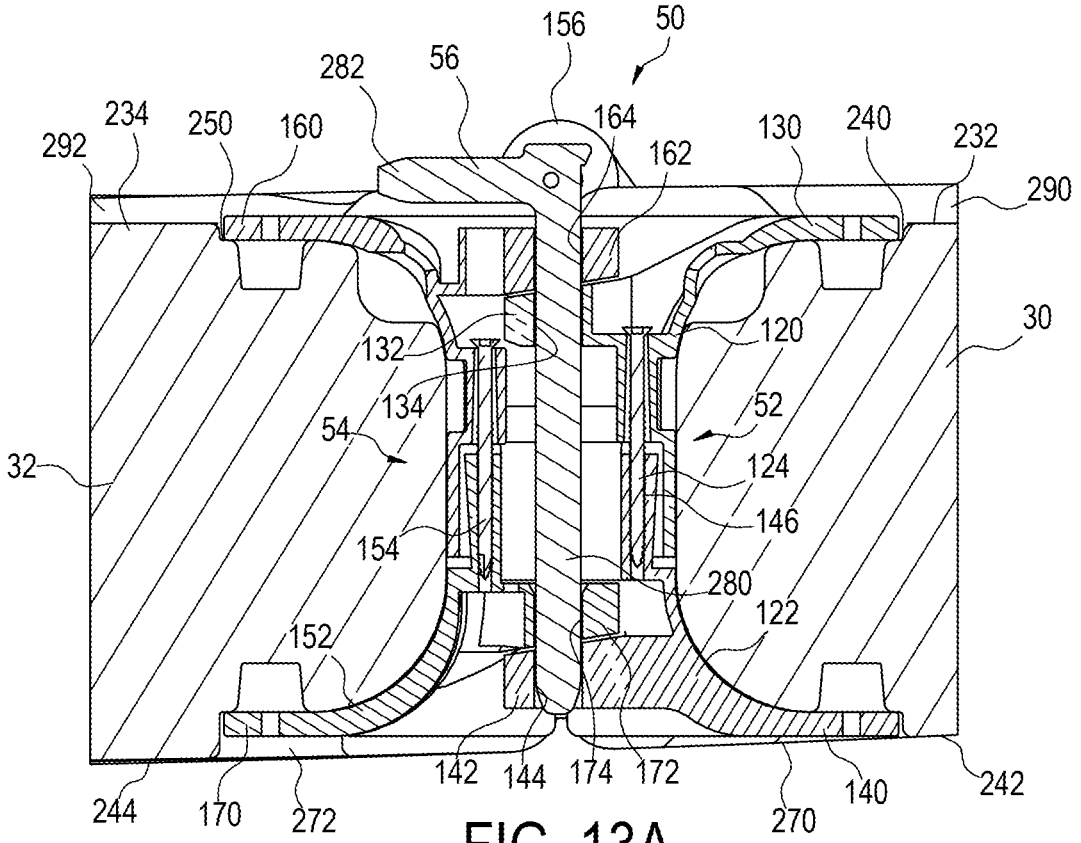
FIG. 13A is a section view taken along lines 13-13 of a first connecting assembly of the first connecting system of the first example foldable kayak.
Figure 13B:
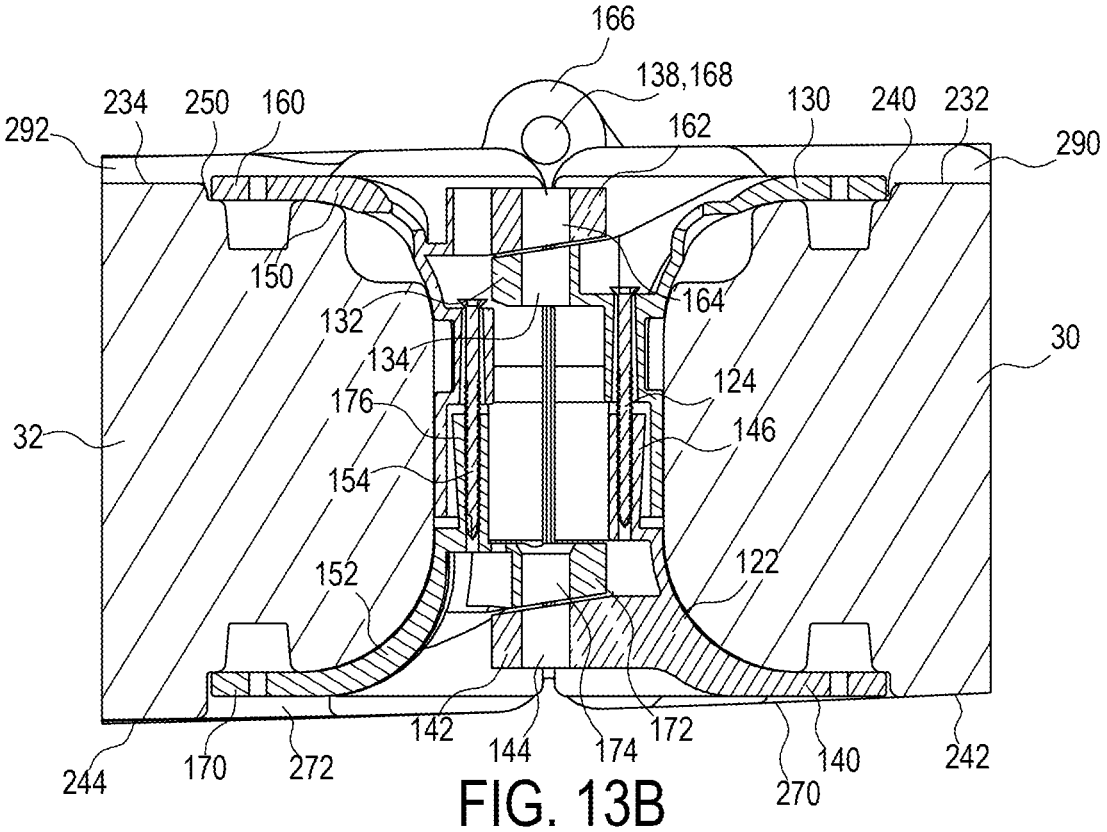
FIG. 13B is a section view similar to that of FIG. 13A depicting the first connecting assembly with a first example connecting member removed for clarity.
Figure 14:
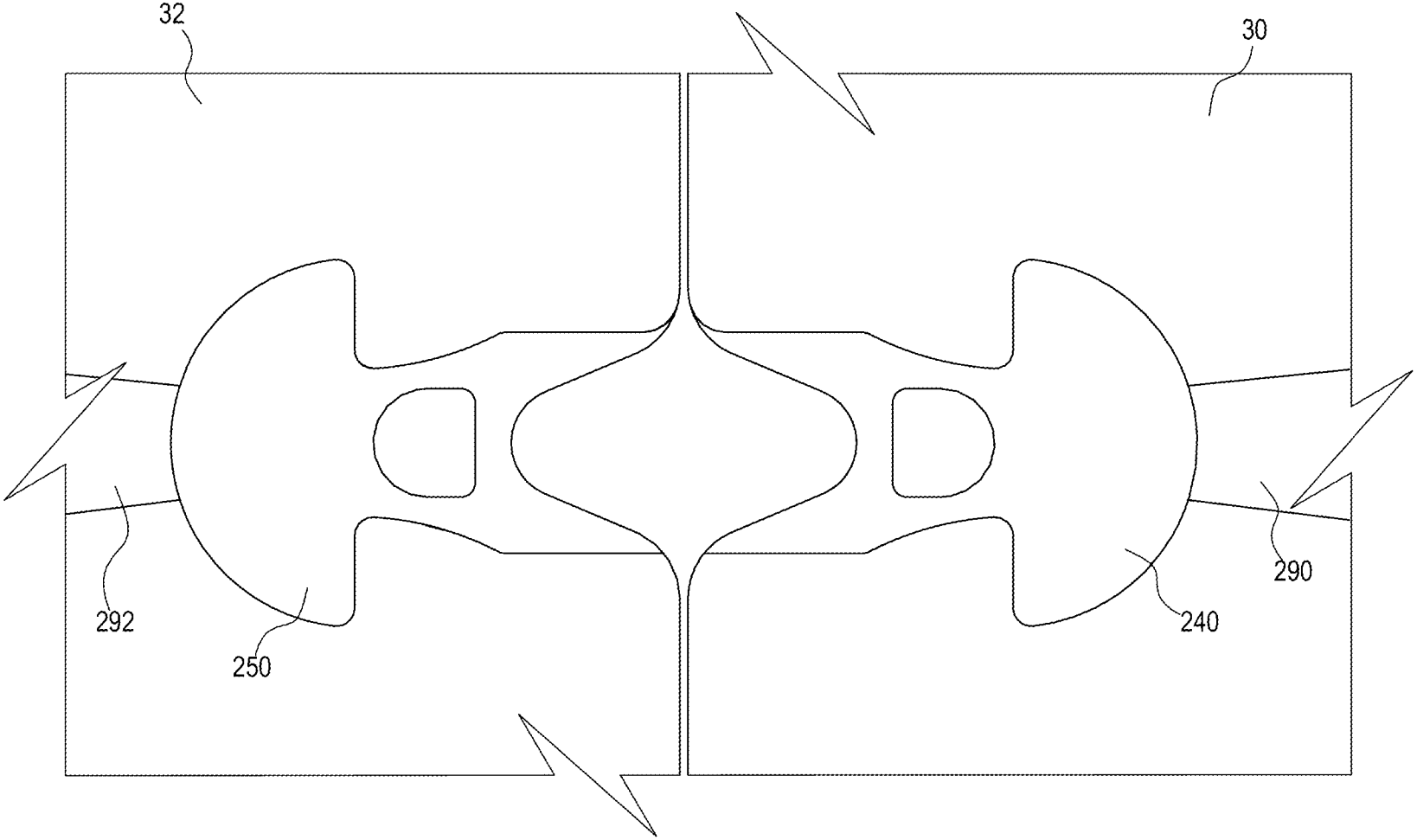
FIG. 14 is a top, plan, detail view of a portion of an upper surface of the first example foldable kayak with the first example connecting assembly removed.
Figure 15:
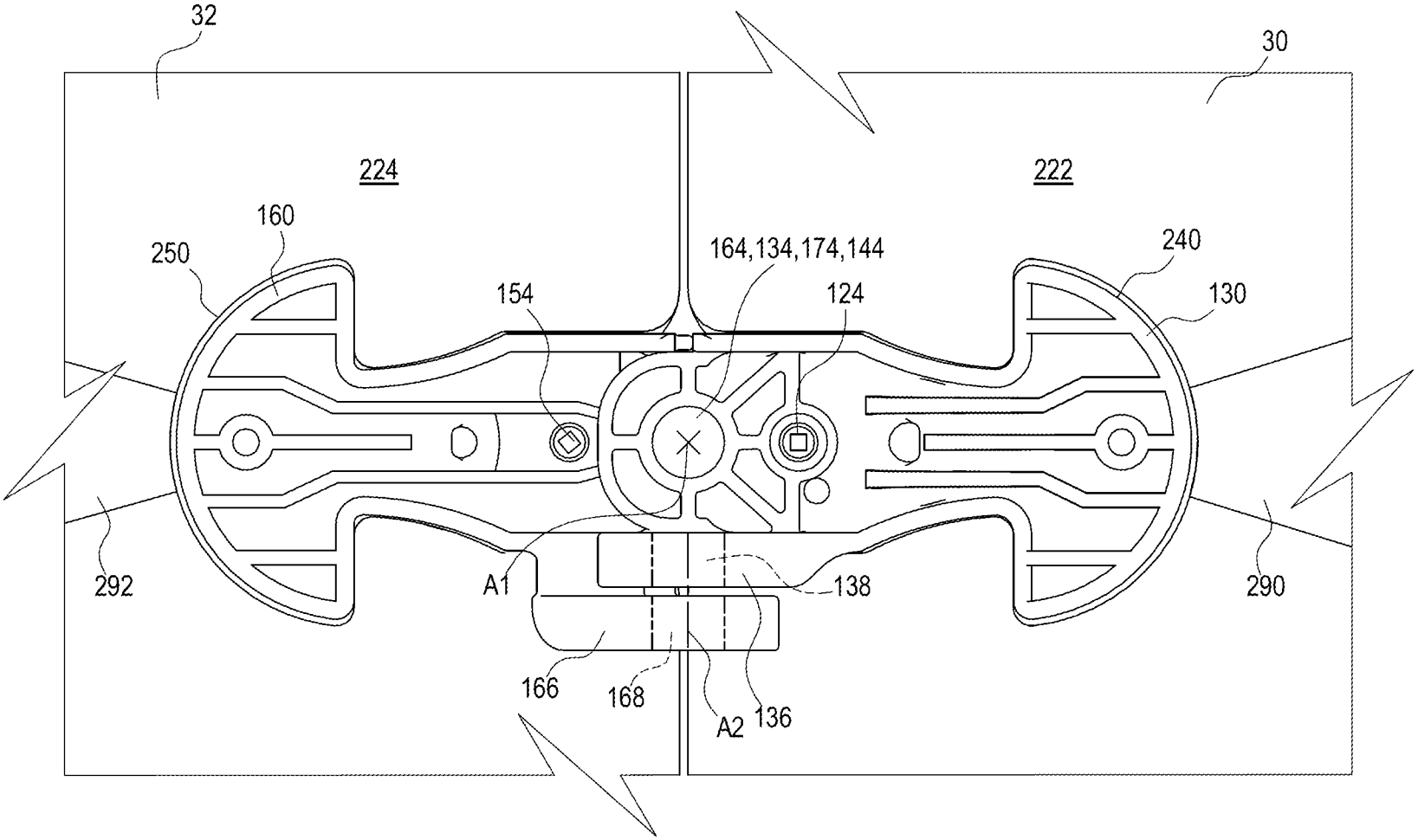
FIG. 15 is a top, plan, detail view of a portion of an upper surface of the first example foldable kayak with the first example connecting assembly in place but the first example connecting member removed for clarity.
Figure 16:
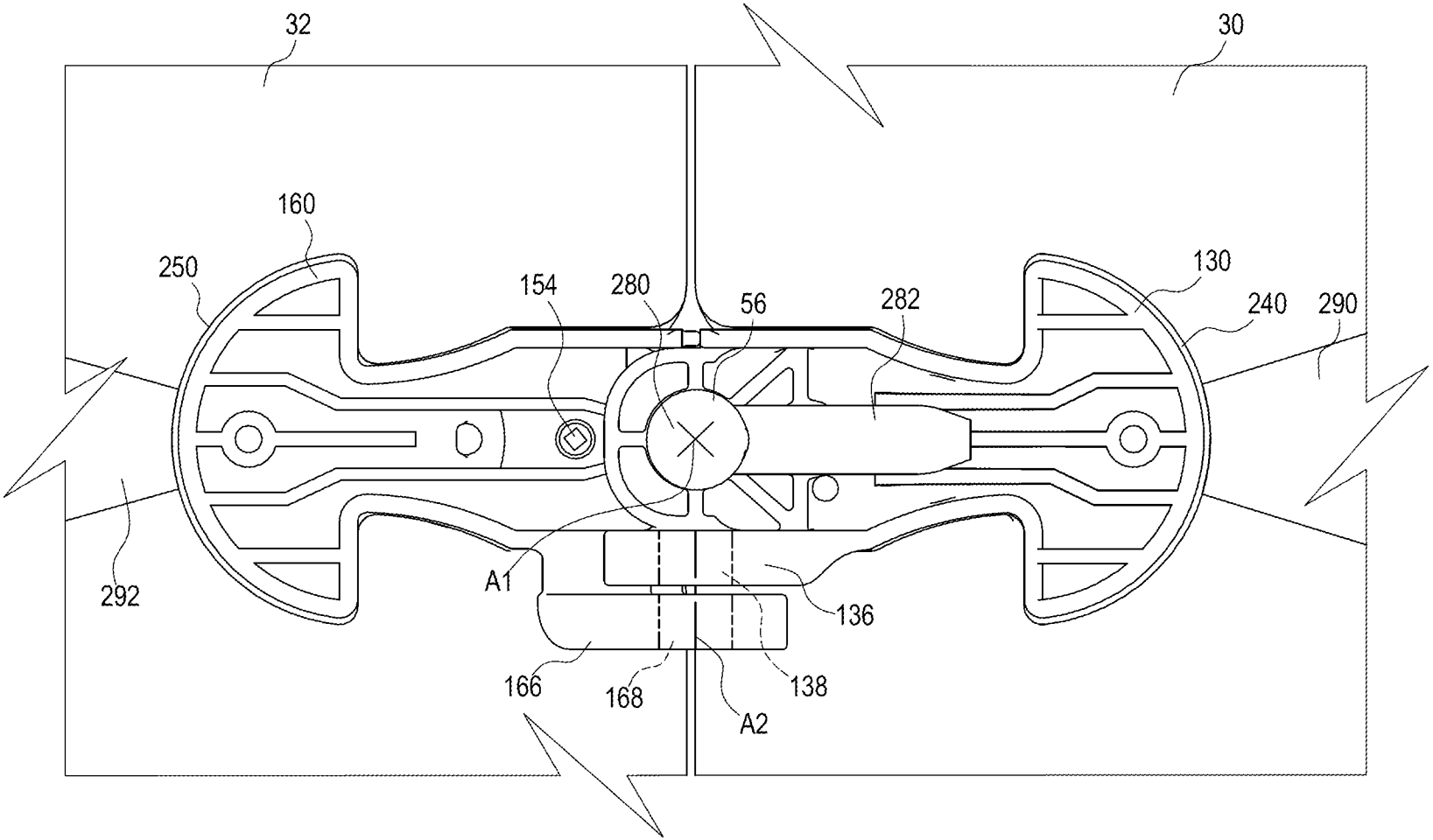
FIG. 16 is a top, plan, detail view of a portion of an upper surface of the first example foldable kayak with the first example connecting assembly in place and the first example connecting member arranged to place the first example connecting assembly in the locked configuration.

As perhaps best shown in FIGS. 3 and 12, the first example watercraft 20 defines an upper surface 220 formed by a first upper surface portion 222 of the first watercraft section 30, a second upper surface portion 224 of the second watercraft section 32, and a third upper surface portion 226 of the third watercraft section 34. FIG. 3 further illustrates that the first example watercraft 20 defines a lower surface 230 formed by a first lower surface portion 232 of the first watercraft section 30, a second lower surface portion 234 of the second watercraft section 32, and a third lower surface portion 236 of the third watercraft section 34.

FIG. 12 further illustrates that the example first watercraft section 30 defines first and second key upper sockets 240 and 242, the example second watercraft section 32 defines third, fourth, fifth, and sixth upper key sockets 250, 252, 254, and 256, and example the third watercraft section 34 defines seventh and eighth upper key sockets 260 and 262. Corresponding lower key sockets (not visible in FIG. 12) are formed in the lower surface portions 232, 234, and 236 immediately below each of the example upper key sockets 240, 242, 250, 252, 254, 256, 260, and 262, and first and third lower key sockets 270 and 272 are visible in FIGS. 13A and 13B.

As perhaps best shown in FIGS. 13A, 13B, 15, 16, and 17, each of the key sockets is designed to snugly receive one of the key tabs such that longitudinal and lateral movement of the key tabs relative to the key sockets is inhibited, minimized, or substantially prevented, thereby substantially rigidly securing each of the connecting assemblies 50 in place relative to two of the watercraft sections 30 and 32 or 32 and 34. Accordingly, the shape and dimensions of each of the example key sockets are predetermined to match the shape and dimensions of the key tab that is received within that particular key socket. In the example watercraft 20, the example key sockets and key tabs all have the same or similar shape and dimensions such that the connecting assemblies 50 are interchangeable, but key sockets and corresponding tabs of different shapes and dimensions may be used if the connecting assemblies serve different structural purposes.

As shown in FIGS. 2, 8-11, 13A, 13B, 16, and 17, the example connecting member 56 comprises a first pin portion 280 and a second pin portion 282. The example first pin portion 280 is longer than the example second pin portion 282 and is adapted to inserted through the aligned lock openings 164, 134, 174, and 144 when the connecting assembly 50 is in the locked configuration. The relatively shorter second portion 282 is adapted to be inserted through the aligned pivot openings 138 and 168 when the connecting assembly 50 is in the pivot configuration. The first and second pin portions 280 and 282 may have the same diameter or different diameters. Alternatively, the connecting member 56 may take the form of a straight pin or rod that is used in both the lock configuration and in the hinge configuration.

Figure 17:
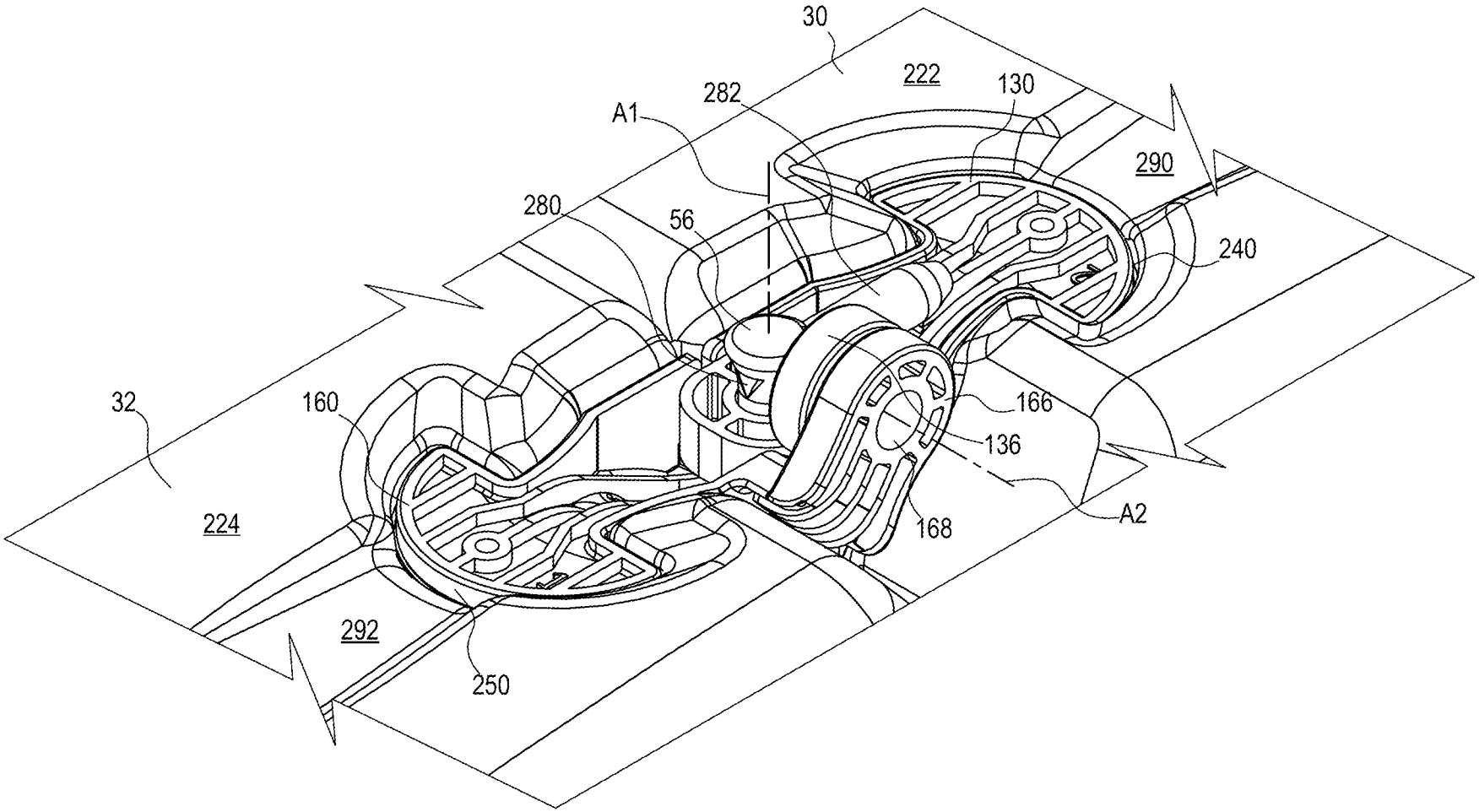
FIG. 17 is an upper perspective detail view of a portion of an upper surface of the first example foldable kayak with the first example connecting assembly in place and the first example connecting member arranged to place the first example connecting assembly in the locked configuration.

As shown in FIG. 17, the example second pin portion 282 is arranged to extend parallel to a longitudinal axis of the example watercraft 20 and inboard of the innermost hinge projection (e.g., the example first hinge projection 136) when the example connecting member 56 is the locked position.

When the example connecting member 56 is in the hinge position, the example first pin portion is arranged to extend parallel to a longitudinal axis of the example watercraft 20 and inboard of the innermost hinge projection (e.g., the example first hinge projection 136) as perhaps best shown in FIG. 9.

Figure 5:
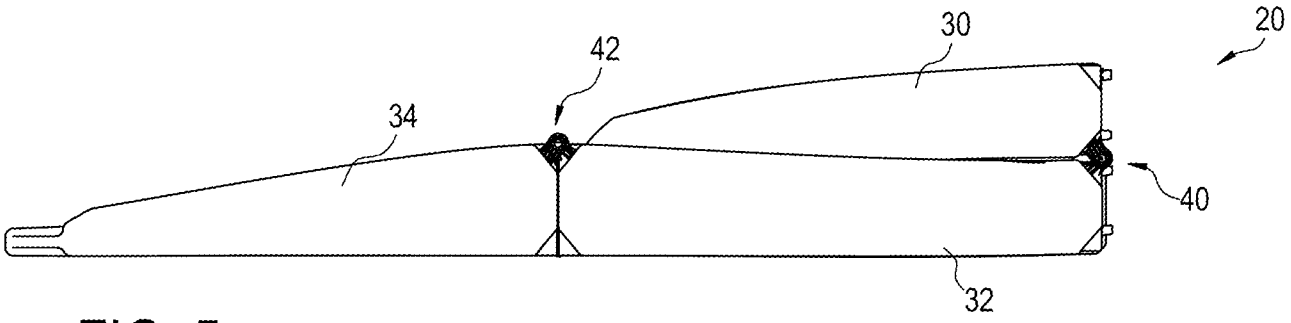
FIG. 5 is a side elevation view illustrating a second step of the process of converting the first example foldable kayak from the first configuration to the second configuration.
Figure 6:
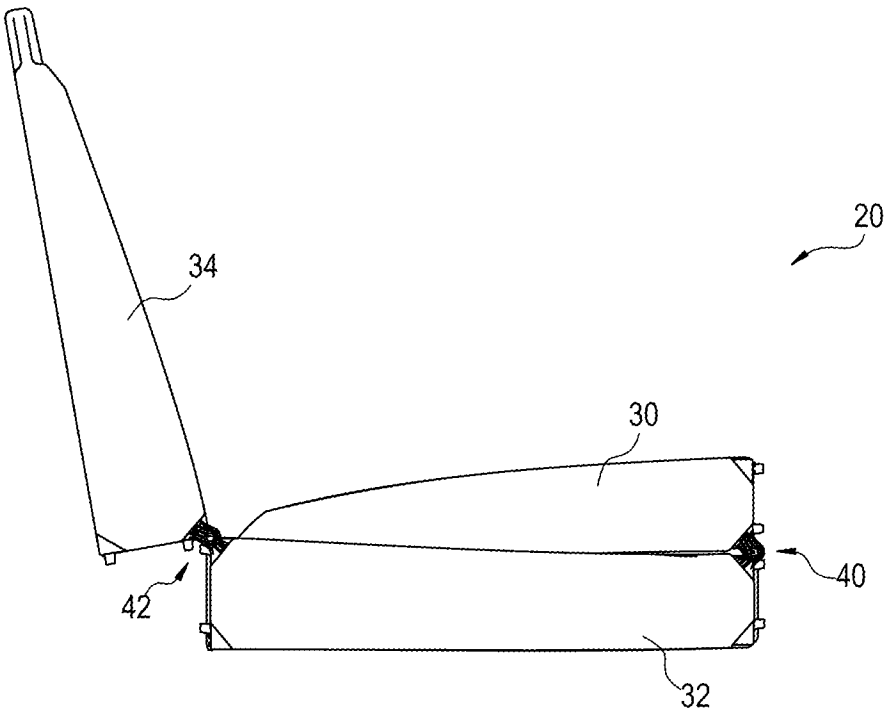
FIG. 6 is a side elevation view illustrating a third step of the process of converting the first example foldable kayak from the first configuration to the second configuration.
Figure 7:
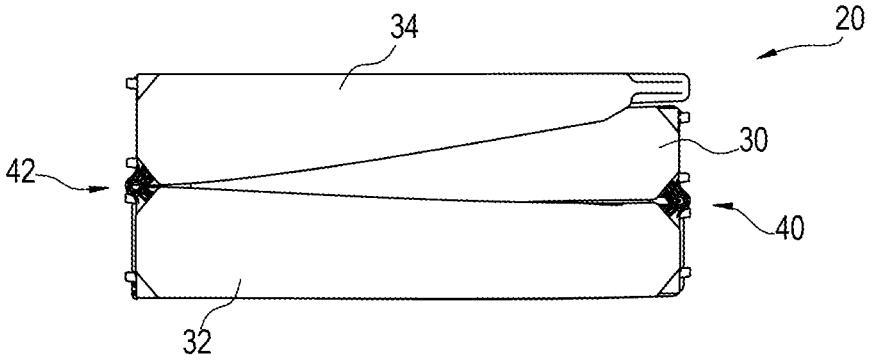
FIG. 7 is a side elevation view illustrating the first example foldable kayak in the second configuration.

As shown in FIG. 17, hinge grooves 290 and 292 are formed in the upper surface portions 222 and 224 of the watercraft sections 30 and 32, respectively. The hinge grooves 290 and 292 are arranged to accommodate the first pin portion 280 of the connecting member 56 when the first watercraft section 30 is folded onto the second watercraft section 32 as shown in FIGS. 5-7. The hinge grooves 290 and 292 thus prevent the connecting member 56 from interfering with reconfiguration of the example watercraft 20 from the first configuration into the second configuration.

Figure 18:
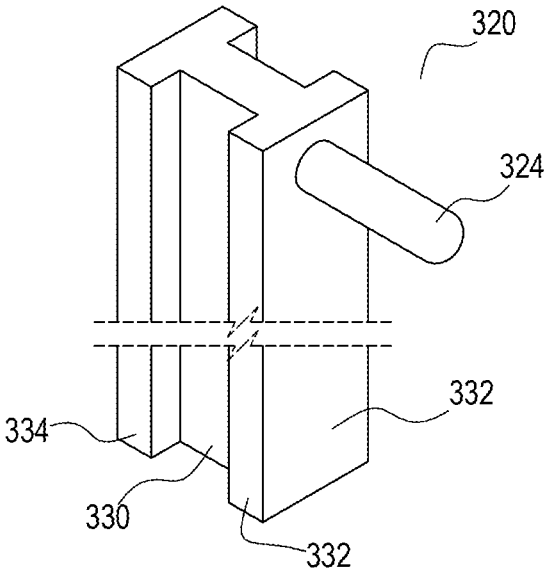
FIG. 18 is a perspective view of a second example connecting member that may be used by the present invention.
Figure 19:
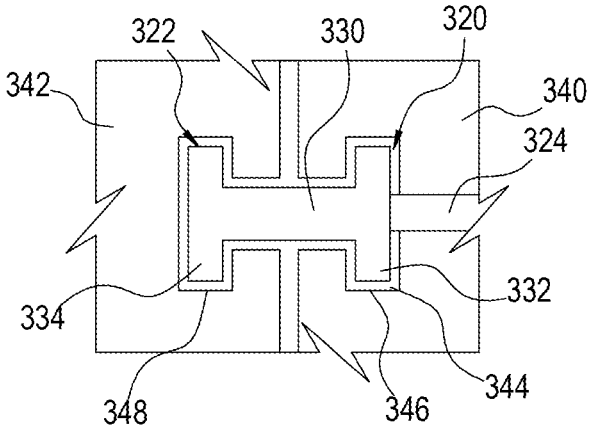
FIG. 19 is a top plan view of a portion of a second example connecting assembly with the second example connecting member arranged to place the second example connecting assembly in a locked configuration.

FIGS. 18 and 19 illustrate a second example connecting member 320 that may be used in place of the first example connecting member 56 described above. The second example connecting member 320 comprises a profiled portion 322 and a pin portion 324. The example profiled portion 322 comprises a connecting portion 330, a first bearing portion 332, and a second bearing portion 334 and defines a first I-shape. FIG. 19 illustrates portions of first and second connecting portions 340 and 342 adapted to be joined together by the second example connecting member 320. The first and second connecting portions 340 and 342 are sized and dimensions such that, when the watercraft is in the first (e.g., use) configuration, the connecting portions 340 and 342 define a connecting opening 344 configured to receive the profiled portion 322 of the second example connecting member 320.

To accommodate the profiled portion 322 of the second example connecting member 320, the example connecting portions 340 and 342 each define first and second T-slots 346 and 348 symmetrically arranged such that the example connecting opening 344 forms a second I-shape that is slightly larger than the first I-shape. As shown in FIG. 19, the I-shape inhibits or substantially prevents longitudinal and lateral movement of the watercraft sections relative to each other when the first and second connecting portions 340 and 342 are joined to the watercraft sections. The example first and second connecting portions 340 and 342 may otherwise be similar to or the same as the first and second connecting portions 52 and 54 described above.

Figure 20:
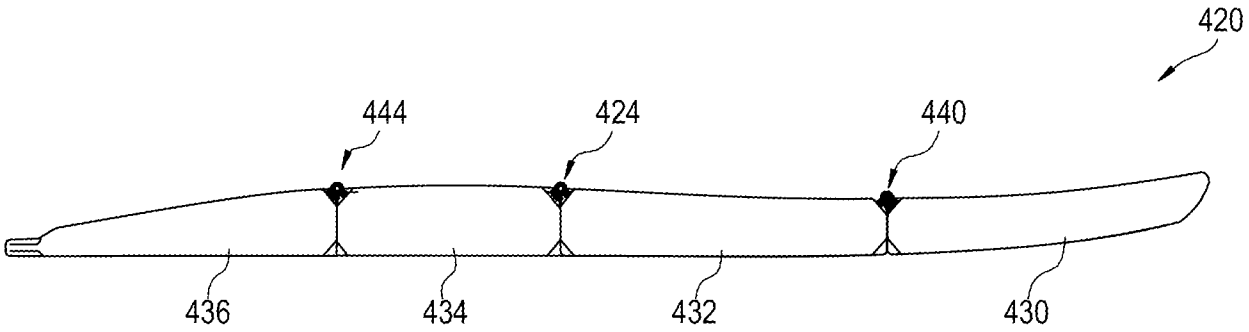
FIG. 20 is a side elevation view of a second example reconfigurable watercraft in a first configuration.

FIG. 20 illustrates a second example watercraft 420 comprising bow, first intermediate, second intermediate, and stern sections 430, 432, 434, and 436 and first, second, and third connecting systems 440, 442, and 444. The bow section 430, first intermediate section 432, and stern section 436 are or may be the same as the bow section 30, intermediate section 32, and stern section 34 described above. The first, second, and third connecting systems 440, 442, and 444 are or may be the same as the first and second connecting systems 40 and 42 described above. The second intermediate section 434 may be optionally used such that the second example watercraft 420 is longer than the first example watercraft 40.

What is claimed is:

1. A reconfigurable watercraft comprising:

a first section defining at least upper and lower first key sockets;

a second section defining at least upper and lower second key sockets;

a connecting assembly comprising a first upper member comprising a first upper lock projection defining a first upper lock opening, a second upper member comprising a second upper lock projection defining a second upper lock opening, a first lower member comprising a first lower lock projection defining a first lower lock opening, a second lower member comprising a second lower lock projection defining a second lower lock opening a first fastener, a second fastener, and at least one rigid connecting member;

wherein with the first upper member received within the upper first key socket and the first lower member received within the lower first key socket, the first fastener engages the first upper member and the first lower member to secure the first upper member and the first lower member to the first section;

with the second upper member received within the upper second key socket and the second lower member received within the lower second key socket, the second fastener engages the second upper member and the second lower member to secure the second upper member and the second lower member to the second section; and the at least one rigid connecting member extends through the first upper lock opening, the second upper lock opening, the first lower lock opening, and the second lower lock opening to secure the first section to the second section such that the reconfigurable watercraft is secured in a use configuration.

2. A reconfigurable watercraft as recited in claim 1, in which:

the first upper member further comprises a first hinge projection defining a first pivot opening;

the second upper member further comprises a second hinge projection defining a second pivot opening; and with the at least one rigid connecting member extending through the first and second pivot openings, the first section may be pivoted relative to the second section into a storage configuration.

3. A reconfigurable watercraft as recited in claim 1, in which:

the first upper member further defines a first upper lock opening;

the second upper member further comprises a second upper lock opening;

the first lower member further defines a first lower lock opening;

the second lower member further comprises a second lower lock opening; and when the reconfigurable watercraft is in the use configuration, the first upper lock projection is arranged within the second upper lock opening;

the second upper lock projection is arranged within the first upper lock opening;

the first lower lock projection is arranged within the second lower lock opening;

the second lower lock projection is arranged within the first lower lock opening.

4. A reconfigurable watercraft as recited in claim 3, in which:

the first upper member further defines a first upper lock opening;

the second upper member further comprises a second upper lock opening;

the first lower member further defines a first lower lock opening;

the second lower member further comprises a second lower lock opening; and when the reconfigurable watercraft is in the use configuration, the first upper lock projection is arranged within the second upper lock opening;

the second upper lock projection is arranged within the first upper lock opening;

the first lower lock projection is arranged within the second lower lock opening;

the second lower lock projection is arranged within the first lower lock opening.

5. A method of reconfiguring a watercraft between first and second configurations comprising the steps of:

providing a first section defining at least upper and lower first key sockets;

providing second section defining at least upper and lower second key sockets;

providing a connecting assembly comprising a first upper member comprising a first upper lock projection defining a first upper lock opening, a second upper member comprising a second upper lock projection defining a second upper lock opening, a first lower member comprising a first lower lock projection defining a first lower lock opening, a second lower member comprising a second lower lock projection defining a second lower lock opening a first fastener, a second fastener, and at least one rigid connecting member;

with the first upper member received within the upper first key socket and the first lower member received within the lower first key socket, engaging the first fastener with the first upper member and the first lower member to secure the first upper member and the first lower member to the first section;

with the second upper member received within the upper second key socket and the second lower member received within the lower second key socket, engaging the second fastener with the second upper member and the second lower member to secure the second upper member and the second lower member to the second section; and extending the at least one rigid connecting member through the first upper lock opening, the second upper lock opening, the first lower lock opening, and the second lower lock opening to secure the first section to the second section such that the reconfigurable watercraft is secured in a use configuration.

6. A method as recited in claim 5, in which:

the first upper member further comprises a first hinge projection defining a first pivot opening;

the second upper member further comprises a second hinge projection defining a second pivot opening;

the method further comprising the steps of extending the at least one rigid connecting member through the first and second pivot openings; and pivoting the first section relative to the second section into a storage configuration.

7. A method as recited in claim 5, in which:

the first upper member further defines a first upper lock opening;

the second upper member further comprises a second upper lock opening;

the first lower member further defines a first lower lock opening; and the second lower member further comprises a second lower lock opening;

the method further comprising the steps of, when arranging the reconfigurable watercraft in the use configuration, arranging the first upper lock projection within the second upper lock opening;

arranging the second upper lock projection within the first upper lock opening;

arranging the first lower lock projection is arranged within the second lower lock opening;

arranging the second lower lock projection within the first lower lock opening.

8. A method as recited in claim 7, in which:

the first upper member further defines a first upper lock opening;

the second upper member further comprises a second upper lock opening;

the first lower member further defines a first lower lock opening; and the second lower member further comprises a second lower lock opening;

the method further comprising the steps of, when arranging the reconfigurable watercraft in the use configuration, arranging the first upper lock projection within the second upper lock opening;

arranging the second upper lock projection within the first upper lock opening;

arranging the first lower lock projection is arranged within the second lower lock opening;

arranging the second lower lock projection within the first lower lock opening.

* * * * *